US006267322B1

(12) United States Patent
Harmathy

(10) Patent No.: US 6,267,322 B1
(45) Date of Patent: Jul. 31, 2001

(54) TOILET PAPER OR PAPER TOWEL DISPENSER

(76) Inventor: Tibor Zoltan Harmathy, 1834 Playfair Dr., Ottawa, ON (CA), K1H 5S1

( * ) Notice: Subject to any disclaimer, the term of this patent is extended or adjusted under 35 U.S.C. 154(b) by 0 days.

(21) Appl. No.: 09/072,580

(22) Filed: May 4, 1998

(30) Foreign Application Priority Data

Sep. 23, 1997 (CA) ..... 2212569

(51) Int. Cl.[7] ..... B65H 16/02

(52) U.S. Cl. ..... 242/595; 242/419.4; 242/598.5; 225/51; 225/84; 225/106

(58) Field of Search ..... 242/419, 419.4, 242/419.6, 419.8, 595, 598, 598.3, 598.5; 225/39, 42, 46, 47, 51, 82, 84, 77, 80, 106

(56) References Cited

U.S. PATENT DOCUMENTS

| | | | | |
|---|---|---|---|---|
| 452,719 | * | 5/1891 | Ross | 225/82 |
| 1,243,569 | * | 10/1917 | Taylor | 225/51 |
| 1,651,434 | * | 12/1927 | Bell | 242/595 |
| 1,837,507 | * | 12/1931 | Towers | 242/419.4 |
| 2,488,492 | * | 11/1949 | Dumbleton | 242/598.5 |
| 2,626,761 | * | 1/1953 | Simpson et al. | 225/42 |
| 2,699,903 | * | 1/1955 | Montgomery | 242/422.4 |
| 3,494,518 | * | 2/1970 | Goss | 225/46 |
| 3,739,965 | * | 6/1973 | Jespersen et al. | 225/96 |
| 4,454,974 | * | 6/1984 | Cooke | 242/598.3 |
| 4,467,974 | * | 8/1984 | Crim | 242/419.4 |
| 4,660,781 | * | 4/1987 | Hazard | 242/421.3 |
| 4,913,364 | * | 4/1990 | Hu | 242/598.5 |
| 4,919,350 | * | 4/1990 | Miller | 242/423 |
| 5,215,274 | * | 6/1993 | Lin | 242/563.2 |
| 5,249,755 | * | 10/1993 | Jespersen | 242/596.7 |
| 5,651,487 | * | 7/1997 | Hansen | 225/84 |

FOREIGN PATENT DOCUMENTS

| | | | | |
|---|---|---|---|---|
| 1294626 | * | 5/1969 | (DE) | 242/598.5 |
| 1440814 | * | 4/1966 | (FR) | 242/595 |

* cited by examiner

*Primary Examiner*—Donald P. Walsh
*Assistant Examiner*—Emmanuel M. Marcelo

(57) ABSTRACT

This invention relates to a device which offers a person the convenience of tearing off with one hand any length of a flexible sheet material, typically toilet paper or kitchen towel, from a roll at a line of weakness (perforation) in the sheet. The device consists of two main components: a stable "cradle" and a movable "pallet". The cradle is made up of a back plate whereby it is fastened to a solid surface, two side plates between which the roll is held, possibly a bottom plate on which (with the most practical embodiment of the invention) the roll rests, and a "lower jaw bar". The pallet is rotatably attached to the side plates of the cradle. The active parts of the pallet are two cross bars: the "upper jaw bar" and the "press bar". In preparing for use, the free end of the sheet material is passed through the gap between the upper jaw bar and the press bar of the pallet in such a way that the upper jaw bar lies above and the press bar below the sheet; then the roll is installed in the cradle. Pulling the free end of the sheet away from the roll will cause the upper jaw bar to lift away from the lower jaw bar, thus any length of the sheet material can be freely unwound from the roll. By shifting the direction of the pull toward the lower jaw bar, the pressure on the press bar will force the upper jaw bar against the lower jaw bar, and thus prevent further material from unwinding from the roll. By increasing the pull, any length of material outside the press bar can be separated from the roll along a line of weakness in the sheet.

3 Claims, 2 Drawing Sheets

TOILET PAPER OR PAPER TOWEL DISPENSER

SUMMARY OF INVENTION

The device enables one to tear off with one hand any length of a flexible sheet material, typically toilet paper or kitchen towel, from a roll at a line of weakness (perforation) in the sheet. It consists of a stable "cradle" and a movable "pallet". Pulling away from the roll, the sheet material is freely unwound from the roll. Changing the direction of the pull will cause the pallet to grab the sheet, and thereby prevent further unwinding of the sheet. Increasing the pull will allow any piece of the sheet material to be separated from the roll along a line of weakness.

SPECIFICATION

Various flexible sheet materials are marketed in the form of strips rolled up usually on a paper tube. To facilitate the separation of pieces of the sheet from the roll, the manufacturers, as a rule, provide lines of weakness (e.g., perforations) in the sheet at regular intervals. Toilet papers and paper kitchen towels are the most common examples of such flexible sheet products. In the following discussions, the term "the roll" will be used for the sake of brevity to denote any kind of flexible sheet material marketed in rolls.

People are often annoyed by the fact that tearing off a suitable length of the sheet from the roll requires both hands: one to pull the material off the roll, and the other to hold the roll to prevent it from overspinning on the spindle on which the roll is usually placed, when the pull is increased in order to separate a piece of required length from the roll. It often happens that one hand of the user is dirty or wet, and therefore the paper still on the roll may become dirty, unsanitary, or weakened by moisture.

Many suggestions have already been made to allay the problem of overspinning. Devices have been described in U.S. Pat. No. 2,699,903, U.S. Pat. No. 3,739,965, U.S. Pat. No. 4,660,781, U.S. Pat. No. 4,913,364, U.S. Pat. 4,919,350, U.S. Pat. No. 5,215,274, U.S. Pat. No. 5,249,755, etc. Clearly, to successfully cope with the problem it is essential to brake or check the spinning of the roll at the moment the tearing force is applied. Several difficulties have been encountered, however, with the suggested solutions. Among them: the device may not provide sufficient braking effect at all possible weight or size of the roll, or the length of the piece torn off may be limited to one unit length between two lines of weakness in the sheet, or the device may be complicated and costly.

The device to be described here is simple, reliable, and allows the user to separate from the roll any length of the sheet material measured in multiples of the unit size marked by the lines of weakness (perforations).

In the drawings which illustrate the embodiments of the invention:

Figure 1:
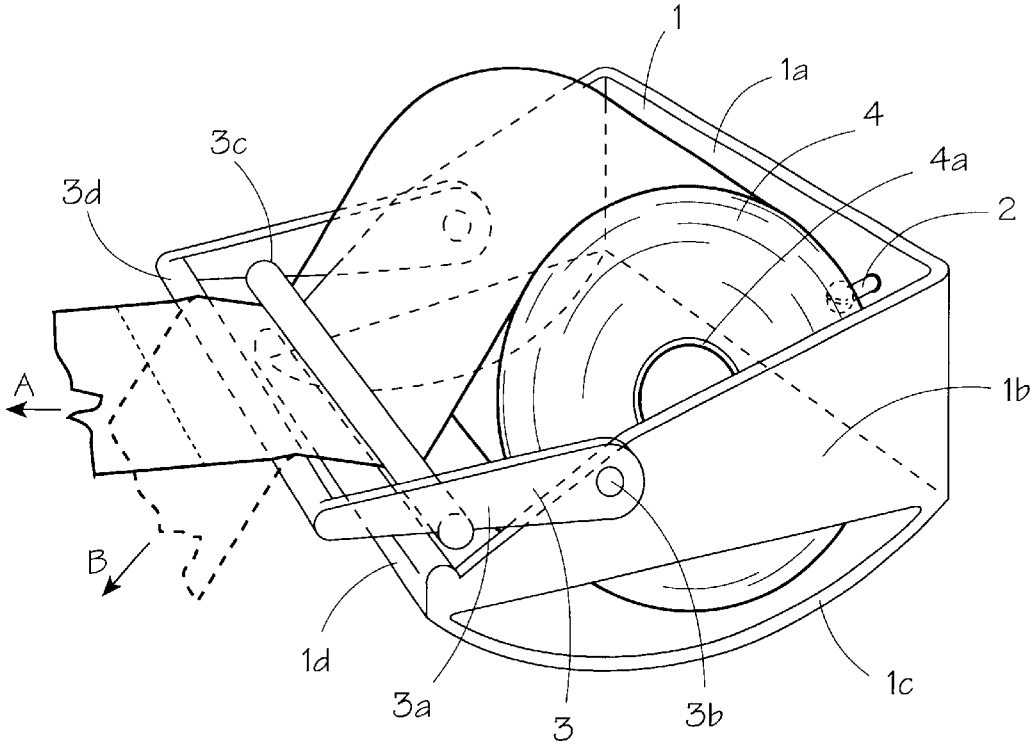
FIG. 1 is a perspective view of the most practical variant of the device described in the present invention.

As shown in FIG. 1, the most practical variant of the device consists of a stable component referred to as "cradle", 1, and a movable component referred to as "pallet", 3. The cradle is made up of a back plate, 1*a*, two side plates, 1*b*, a bottom plate, 1*c*, and a cross bar referred to as "lower jaw bar", 1*d*. The cradle is fastened to some essentially vertical surface by screws, 2, in such a way that the axis of the roll lies in an essentially horizontal plane. The pallet is made up of two arms, 3*a*, which are rotatably attached to the side plates of the cradle by two pins, 3*b*. The active parts of the pallet are two cross bars, one referred to as "upper jaw bar", 3*c*, and the other referred to as "press bar", 3*d*. In preparing for use, the free end of the roll, 4, (the core of which is a tube, 4*a*, usually made from paper) is passed through the gap between the upper jaw bar and the press bar of the pallet in such a way that the upper jaw bar lies above of the sheet and press bar below the sheet. Then the roll is placed on the bottom plate of the cradle.

If the free end of the sheet is pulled in a direction away from the roll, as indicated by letter A, the upper jaw bar is lifted away from the lower jaw bar, and thus any length of the sheet material can be freely unwound from the roll. Shifting the direction of the pull toward the lower jaw bar of the cradle, as indicated by letter B, the pressure on the press bar will force the upper jaw bar against the lower jaw bar, thereby preventing the unwinding of further material from the roll. By increasing the pull, any length of the sheet (depending on where a person holds the unwound material) can be separated from the roll.

Clearly, the described variant of the device can only be used if the back plate of the cradle is attached to an essentially vertical surface and the axis of the roll lies in an essentially horizontal plane, so that the cradle can hold the roll by gravity. If the back plate of the cradle is attached to an essentially horizontal surface facing down, or if the back plate is attached to an essentially vertical surface and the axis of the roll lies in an essentially vertical plane, gravity cannot be relied upon in positioning the roll in the cradle.

Figure 2:
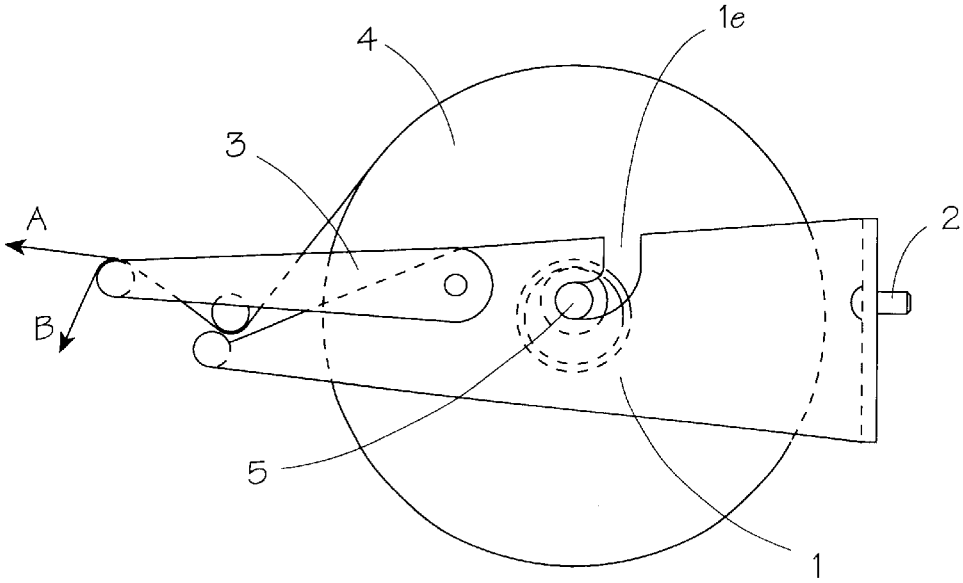
FIG. 2 is the side view of another variant of the device.
Figure 3:
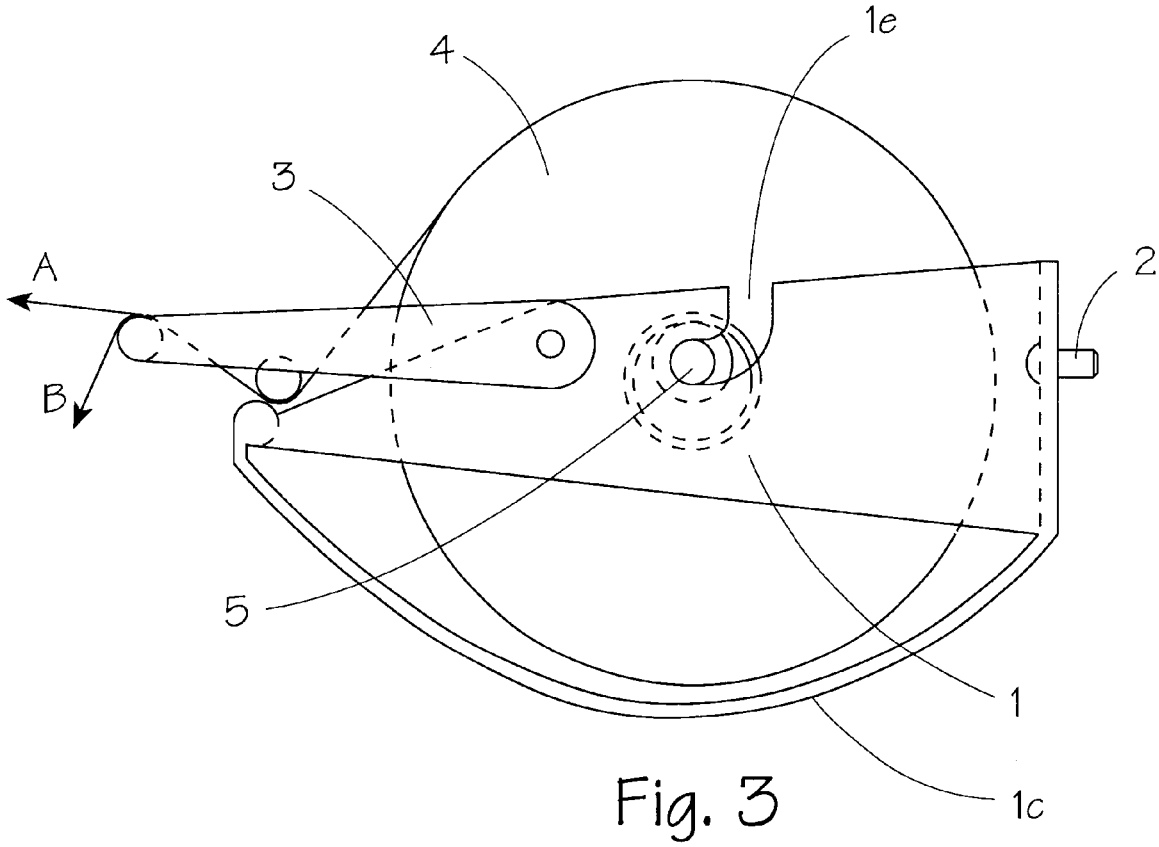
FIG. 3 is the side view of a third variant of the device.

FIG. 2 shows a variant of the device to be used whenever the variant shown in FIG. 1 is not appropriate. Most of the components of this second variant are similar to and play similar functions as those of the variant in FIG. 1. The corresponding parts are denoted by the same numbers. The main difference between the two variants is that with the second variant a spindle, 5, is passed through the hollow core, 4*a*, of the roll, 4. The ends of the spindle are secured in holes or grooves, 1*e*, in the sides plates of the cradle. Clearly, with this variant the bottom plate of the cradle (1*c* in FIG. 1) is not needed.

The second variant can be used even when the first variant may be sufficient, and therefore its applicability is wider than that of the first variant. It may also prove practical to combine the features of both variants, i.e., to use cradles that have bottom plates as well as side plates with holes or grooves for a spindle.

The embodiments of the invention in which an exclusive property or privilege is claimed are defined as follows:

1. Device for dispensing any flexible sheet material rolled up on a core, the device consisting of two parts: a stable part, the cradle, and a movable part, the pallet; the cradle being made up of constituents suitable for attaching it to a holding surface and accepting the roll, and of a cross bar, the lower jaw bar on the side of the roll away from the holding surface; the pallet being composed of two side arms rotatably attached to the sides of the cradle between the holding surface and the lower jaw bar with pivots and connected by two cross bars: the upper jaw bar and the press bar, the upper jaw bar at such a distance from the pivots that it can mesh with the lower jaw bar of the cradle, and the press bar somewhat farther from the pivots; in using the device, the free end of the sheet material is passed through the gap between the upper jaw bar and the press bar of the pallet in such a way that the upper jaw bar lies above and the press bar below the sheet, and then the roll is placed in the cradle;

by pulling the sheet away from the roll the upper jaw bar is lifted from the lower jaw bar and thus any length of the sheet material can be unwound from the roll; by shifting the direction of the pull toward the lower jaw bar, the pressure on the press bar forces the upper jaw bar against the lower jaw bar and prevents further sheet material from unwinding from the roll thus, by increasing the pull on the sheet and holding the sheet near the press bar, any length of sheet material can be separated from the roll.

2. Device as defined in claim 1, in which the side plates of the cradle have holes or grooves for a spindle on which the roll is placed.

3. Device as defined in claim 1, in which the cradle has a bottom plate for holding the roll by gravity, as well as holes or grooves for a spindle for the roll if holding the roll by gravity is not possible or not desirable.

* * * * *